United States Patent [19]

Moriarty

[11] Patent Number: 4,475,534

[45] Date of Patent: Oct. 9, 1984

[54] VENTILATING SYSTEM FOR KITCHEN STOVE

[76] Inventor: Daniel J. Moriarty, 15294 Woodcrest Dr., Whittier, Calif. 90604

[21] Appl. No.: 965,094

[22] Filed: Nov. 30, 1978

[51] Int. Cl.[3] ..... F24C 15/08; F23J 11/00

[52] U.S. Cl. ..... 126/299 D; 98/115 LH; 55/DIG. 36

[58] Field of Search ..... 126/299 D; 98/36, 115 R, 98/115 LH, 115 SB; 55/DIG. 36, DIG. 29

[56] References Cited

U.S. PATENT DOCUMENTS

| | | | |
|---|---|---|---|
| 3,254,588 | 6/1966 | Truhan | 98/115 LH |
| 3,530,784 | 9/1970 | Courchesne | 126/299 D |
| 3,585,919 | 6/1971 | Culpepper, Jr. | 126/299 D |
| 4,043,319 | 8/1977 | Jensen | 126/299 D |
| 4,089,327 | 5/1978 | Welsh | 126/299 D |
| 4,127,106 | 11/1978 | Jensen | 126/299 D |

FOREIGN PATENT DOCUMENTS

| | | | |
|---|---|---|---|
| 1314447 | 12/1962 | France | 98/115 LH |

OTHER PUBLICATIONS

Laboratory Furniture Co., Inc., Catalog No. 56H, p. 19, dated 6/12/58.

*Primary Examiner*—Margaret A. Focarino
*Attorney, Agent, or Firm*—Daniel C. McKown

[57] ABSTRACT

An energy-saving ventilating system for a restaurant kitchen stove provides a first air stream flowing upwardly from a location adjacent the rear edge of the cooking surface, a second air stream discharged into the space in front of the stove where the cook stands and flowing rearwardly above the cooking surface, and a third air stream discharged downwardly from an outlet above the front portion of the cooking surface so as to squeeze the second air stream as the latter flows over the front edge of the cooking surface, causing the second air stream to flow faster in that area, the third air stream acting as an invisible baffle to reduce induction of conditioned air from the kitchen into the space above the cooking surface.

2 Claims, 4 Drawing Figures

28
26
58
30
24
60
32
62
64
70
68
46
20
66
74
72
34
82
80
38
40
36
42
54
56
44
86
48
57
59
50
93
91
52
76
78
18
84
16
96
92
10
12
14
22

28
26
58
30
24
60
64
32
46
34
20
72
38
44
40
42
36
48
86
93
76
78
18
84
16
92
96
12
10
14
22

28
26
58
30
32
24
60
46
34
64
44
38
98
72
36
40
42
48
86
93
76
78
92
18
84
16
96
12
10
14
22

VENTILATING SYSTEM FOR KITCHEN STOVE

BACKGROUND OF THE INVENTION

1. Field of the Invention

The present invention is in the field of kitchen ventilating systems, and more particularly is a system for removing cooking fumes from a kitchen where such fumes are produced in large quantities, as in a restaurant.

2. The Prior Art

A number of techniques have been used to dispose of the fumes produced in large-volume indoor cooking operations. Because the fumes are airborne, it is usual to urge the fume-laden air into an exhaust hood or plenum through which it is conducted to the outdoors, normally by the assistance of an exhaust blower. The main challenge is to capture all of the fume-laden air to prevent its escape into the kitchen, and to accomplish this end with a minimum expenditure of energy.

There are two main ways in which energy is expended. The first way is in moving the air within the ventilating system. It is well known that the energy expended is approximately proportional to the amount of air moved, and increases rapidly if higher velocities are required. Thus, if energy expenditure is to be minimized, excessive air velocities and excessive volumetric flows should be avoided.

The second main way in which energy is expended is by the undesirable discharge of conditioned air; that is, air which has been heated, cooled, filtered, humidified or dehumidified to make it comfortable to persons inside the building. When fume-laden air is removed from the building by the exhaust system, the air removed must be replace, or made up for, by bringing an equal volume of "make-up air" into the building. It would be ideal if the stove ventilating system could operate with only unconditioned make-up air, so that none of the more expensive conditioned air would be blown out the exhaust. In practice this ideal has not been attained, and typically 40 to 60 percent of the air discharged in the exhaust is made up of conditioned air, in a well designed installation. The degree to which the ideal is approached depends on the design of the system, which in turn must respond to numerous other constraints and desiderata which in some instances may conflict with the goal of minimizing the discharge of conditioned air. Some of these other constraints and desiderata are: the physical layout of the kitchen; the requirements of the building code, intended to promote health and safety; the margin of reserve provided to enable the system to cope with overload conditions; ease of maintenance; comfort of the cook; installation cost; and, cost of operation.

One approach to the design of the stove ventilatng system is shown in U.S. Pat. No. 3,292,525, issued Dec. 20, 1966 to Jensen. Jensen locates a make-up air outlet adjacent the front edge of the cooking surface and blows through the outlet a blanket of unconditioned air directed rearwardly and upwardly toward the mouth of an exhaust hood. The blanketing air must be discharged through the outlet with a relatively high velocity to assure that the horizontal velocity component of the air at a point over the cooking surface will be roughly comparable to the vertical velocity component of the fumes at that point. To produce such a high velocity discharge requires considerable energy.

The high velocity air curtain necesarily produces a venturi effect which causes conditioned air from the kitchen to be drawn into and mixed with the air of the curtain, and exhausted into the outdoors, constituting a waste of energy.

Further, the curtain of unconditioned air blows over the hands and arms of the cook, and if the unconditioned air is sufficiently cold the wind-chill factor could cause discomfort to the cook. A similar arrangement is shown by Jensen in U.S. Pat. No. 3,260,189 issued July 12, 1966 and in U.S. Pat. No. 3,386,365 issued June 4, 1968.

A different design approach is shown by Jensen in U.S. Pat. No. 3,400,649 issued Sept. 10, 1968. In that invention, a make-up air duct is located adjacent the rear edge of the cooking surface, and oriented to direct a blanket of air vertically upward. Fumes rising from the cooking surface are drawn toward the upwardly-moving blanket of air by the venturi effect. Although this approach does not subject the hands and arms of the cook to a chilling blast of air, it achieves this advantage at the expense of high energy consumption, because the venturi effect is relatively weak at distances of several feet from the upwardly-moving blanket, necessitating the use of a high velocity discharge. To the extent that the arrangement is effective in drawing fumes into the upwardly-moving blanket, it is also effective in drawing conditioned air from the kitchen into the blanket; consequently, energy is wasted as the conditioned air is exhausted to the outdoors.

This deficiency of the back-shelf ventilator of U.S. Pat. No. 3,400,649 is purported to be remedied by the arrangement shown in U.S. Pat. No. 4,089,327 issued May 16, 1978 to Welsh. As in U.S. Pat. No. 3,400,649, an outlet adjacent the rear edge of the cooking surface produces an upwardly-directed blanket of air toward which the fumes are drawn by the venturi effect. In an effort to prevent so much conditioned air from the kitchen from being drawn into the blanket of air and subsequently exhausted, a large hood is provided, extending forward beyond the front edge of the cooking surface above the cook's head. Within this hood a stream of unconditioned air is directed rearwardly from an outlet inside the front wall of the hood, toward the mouth of the exhaust plenum at the rear of the hood. Although this serves to dilute te exhaust air with unconditioned air, thereby increasing the percentage of unconditioned air, it does nothing to reduce the open space between the hood and the cooking surface, through which conditioned air is drawn from the kitchen. Welch's invention presumably would require greater blower capacity than the system shown in U.S. Pat. No. 3,400,649 for producing and exhausting the airstream within the hood.

From the above description of the prior art it would appear that although the arrangements described are noteworthy as representing different approaches to the use of unconditioned air for make-up, none of the arrangements altogether achieves the goal of capturing all of the fume-laden air with a minimum expenditure of energy.

SUMMARY OF THE INVENTION

The present invention embodies a new approach to the problem of capturing the fume-laden air while minimizing energy consumption. In accordance with the present invention, the induction of conditioned air from the kitchen is greatly reduced by the use of an air outlet in the front end of the hood which discharges a relatively low velocity stream of air vertically downward from the edge of the hood toward the front portion of the cooking surface. A second low velocity stream of conditioned make-up air is discharged into the area in front of the stove where the cook normally stands, and tends to be drawn into the hood by the suction of the exhaust. As this second stream passes under the front edge of the hood while flowing rearwardly, the stream is squeezed or pinched between the cooking surface and the downwardly-directed stream of air discharged from the outlet at the front edge of the hood. This squeezing of the rearwardly moving stream of conditioned air causes it to increase in velocity, thereby forming a jet of higher velocity air flowing rearwardly and upwardly from the front edge of the cooking surface toward the mouth of the exhaust plenum. It is noteworthy that this higher velocity jet, while somewhat comparable to that produced by the outlet arrangement described in U.S. Pat. No. 3,292,525 to Jensen, is achieved in the present invention by the intentional interaction of low-velocity air streams rather than by the energy-consuming approach of producing a single high-velocity discharge (which was the approach used in the prior art).

The air stream directed downwardly from the outlet at the front of the hood in the present invention, because of its relatively low velocity, does not create a stong venturi effect, and thus does not have as great a tendancy as the high velocity air streams, used in the prior art, to induct conditioned air from the kitchen. On the contrary, the downwardly flowing curtain of air in the present invention acts as an invisible baffle to prevent conditioned air from being drawn into the hood from the kitchen by the rearwardly flowing jet produced beneath the hood, while at the same time permitting the cook to see through and to reach through the invisible baffle to tend to the food.

In a preferred embodiment of the present invention, an outlet located adjacent the rear edge of the cooking surface directs a stream of unconditioned air upwardly and forwardly. This stream combines with the rearwardly and upwardly moving jet stream to carry the fumes and the products of combustion upward into the mouth of the exhaust plenum.

In one embodiment of the present invention, the duct supplying air to the outlet at the front edge of the hood includes a jog in a horizontal direction. The upper surface of the duct in this horizontal section serves as a handy plate shelf, since it is located in front of the cook at shoulder height, and therefore does not interfere with his view of the cooking surface.

The second low velocity stream of conditioned make-up air, which as mentioned above is discharged into the area of the kitchen in front of the stove serves the additional function of keeping the cook comfortable. In one embodiment this second low velocity stream is discharged through an outlet located on the ceiling of the kitchen above and behind the cook as he stands before the stove. In this embodiment the conditioned air plenum is located above the ceiling of the kitchen.

In another embodiment, the outlet for this second low velocity stream is located on the underside of a conditioned air plenum which extends forward from the exhaust duct above the area where the cook normally stands, at an elevation between the top of the hood and the ceiling of the kitchen. This conditioned air plenum also houses a lamp in one embodiment. This embodiment is used when, for some reason it is undesirable or impossible to locate the conditioned air plenum above the ceiling of the kitchen.

In a preferred embodiment, the conditioned air plenum used to produce the second low velocity air stream has a structure especially well adapted to produce a uniform discharge flow all along the width of the outlet, which typically extends ten to twenty feet depending on the width of the stove, the plenum being supplied with air by a duct of considerably less width. In the preferred (embodiment, the plenum is a hollow chamber into which the inlet duct extends through a first wall toward a second wall opposite the first wall, terminating nearer to the second wall than to the first wall. In reverse manner, the outlet duct, which extends along the full width of the plenum, extends through the second wall terminating at a position nearer to the first wall than to the second wall. This arrangement of the conditioned air plenum forces the air to pass through it in a circuitous path whereby the forward momentum of the air is dissipated and the air pressure is equalized along the entire width of the outlet duct. In a further improvement, a perforated plate is fitted within and across the outlet duct, and the distribution of air along the width of the outlet is made more uniform, if necessary, by increasing the perforated area in regions of lesser flow.

The ventilating system of the present invention conserves energy in two important ways. First, unlike certain prior art systems, it does not require any high speed air discharges. Since the blower power varies approximately as the third power of the discharge velocity, the low velocity discharges used in the present invention require less power. Second, the hood used in the present invention is relatively small and is located relatively near to the cooking surface (approximately two feet) in comparison with canopy hoods such as shown in U.S. Pat. No. 4,089,327 which typically are located four feet above the cooking surface. This smaller vertical separation minimizes the inflow of conditioned air from the kitchen, thereby conserving the energy used to condition that air. Also, the smaller vertical separation between the hood and the cooking surface in the present invention permits the use of lower air velocities without sacrificing fume handling capability.

The above-mentioned objectives, structural features, and resulting advantages will be further elucidated in the following description, in which several embodiments of the invention will be described with reference to the accompanying drawings. It is to be understood, however, that the various embodiments presented are for the purpose of illustration and explanation and are not intended as defining the limits of the invention.

DETAILED DESCRIPTION OF THE PREFERRED EMBODIMENT

Figure 1:
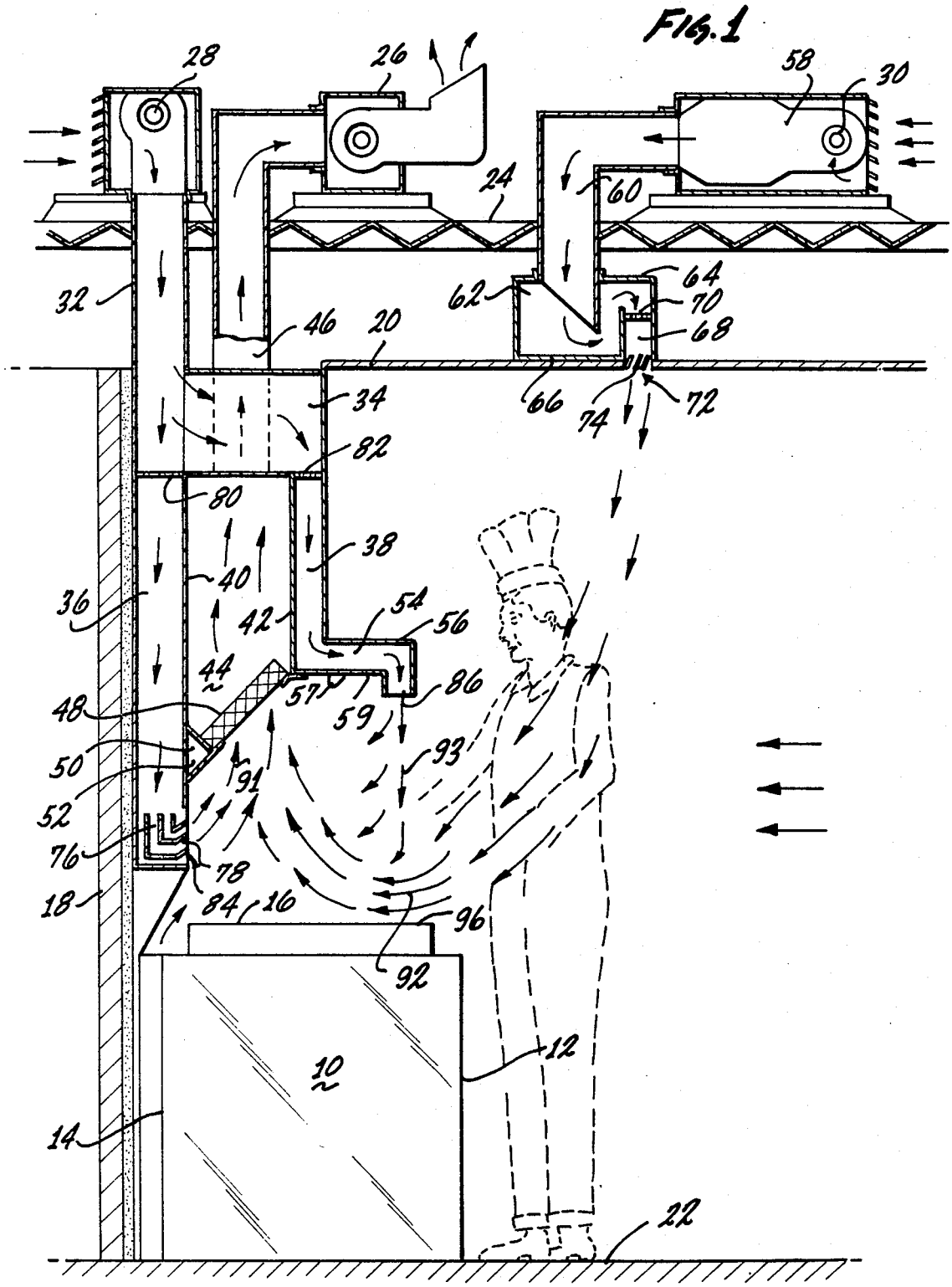
FIG. 1 is a side elevation view in cross section of a preferred embodiment of the present invention in which the conditioned make-up air plenum is located above the ceiling of the kitchen, and in which the hood includes a plate shelf.

Turning now to the drawings, in which like parts are denoted by the same reference numerals, there is shown in FIG. 1 a side cross sectional view of the preferred embodiment of the present invention, on which a number of arrows have been drawn to illustrate the air flows.

The ventilating system of the present invention is installed above a stove 10 which has a front 12, a rear 14, and a cooking surface 16. The rear 14 of the stove 10 is normally placed adjacent a wall 18. The kitchen is bounded vertically by a ceiling 20 and a floor 22. Typically, the cooking surface is 36 inches above the floor, and its top might measure 24 inches from front to back and ten feet or more along its front edge. Normally the cook stands facing the stove as shown in FIG. 1. The dimensions of the stove and its ventilating system are important, and to a large degree the dimensions used are dictated by human engineering factors, such as comfortable working level, visibility, and how far the cook can reach.

On the roof 24 of the restaurant are located an exhaust blower 26, an unconditioned air intake blower 28 and a conditioned air intake blower 30. Outdoor air is drawn by the unconditioned air intake blower 28 into a duct 32 which carries the air to the unconditioned air plenum 34. From the plenum 34, some of the air enters a rear conduit 36 while the remainder of the air flows into a front conduit 38. The space between the front wall 40 of the rear conduit 36 and the rear wall 42 of the front conduit 38 defines an exhaust plenum 44. Air is continually sucked out of the exhaust plenum 44 through the exhaust duct 46 by the exhaust blower 26. In a preferred embodiment, the exhaust duct 46 passes vertically through the unconditioned air plenum 34 although the exhaust duct 46 is sealed from the unconditioned air plenum 34.

A grease extractor 48 spans the mouth of the exhaust plenum 44. The lower end of the grease extractor 48 is supported by a grease trough 50 which channels the grease extracted from the air into a removable receptacle 52. From FIG. 1 it can be seen that the grease extractor 48 and the removable receptacle 52 are located at shoulder height and within reach of the cook. This greatly facilitates removal of the grease extractor 48 and the removable receptacle 52 for cleaning, which may have to be done as often as several times a day.

In the preferred embodiment shown in FIG. 1, the front conduit 38 jogs to include a horizontal section 54. The upper wall 56 of the front conduit 38 is located at a height which permits it to be used conveniently as a plate shelf. A fire extinguishing system 57 may be mounted to the lower surface 59 of the horizontal section 54.

Outside air drawn in by the conditioned air intake blower 30 is heated or cooled as required by the conditioner 58. In some climates and at certain times of the year it may not be necessary to heat or cool the outdoor air; nevertheless, because some conditioning is usually required, the terminology will be retained. From the conditioner 58 the conditioned air passes through a conditioned air duct 60, which is the inlet duct to the conditioned air plenum 62. The conditioned air duct 60 passes through the upper wall 64 of the plenum 62 and extends within the plenum to a position nearer to the lower wall 66 than to the upper wall 64. An outlet duct 68 extends into the conditioned air plenum 62 from the lower wall 66 to a position closer to the upper wall 64 than to the lower wall 66. In a preferred embodiment, the conditioned air duct 60 has a circular cross section and the outlet duct 68 has a rectangular cross section several inches wide and 10 feet long. A perforated metal plate 70 in the outlet duct 68 is used to equalize the flow of air along the longer dimension of the cross section. The outlet duct 68 terminates at a conditioned air outlet 72 which may be provided with vanes 74 for directing the air flow. In a preferred embodiment, the conditioned air plenum is located in the space between the ceiling 20 and the roof 24.

The lower end of the rear conduit 36 is provided with a set of removable vanes 76 for diffusing and directing the air stream. The outlet of the rear conduit is covered by a removable perforated plate 78 to further diffuse and equalize the air flow. Perforated metal plates 80, 82 also are used in the rear and front conduits 36, 38 respectively to equalize the flow along the longer dimension of those conduits and to apportion the flow between them.

In a preferred embodiment, the flow is apportioned so that approximately 40 percent of the exhaust flow in the exhaust duct 46 originates from the outlet 84 which extends along the rear edge of the cooking surface; 35 percent of the exhaust flow, approximately, originates from the outlet 86; and approximately 25 percent of the exhaust flow originates from the conditioned air outlet 72. Thus, approximately 75 percent of the exhaust flow in unconditioned air. This relatively high figure is an important feature of the present invention, resulting in an appreciable energy saving.

In operation, the outlet 84 directs a first stream of air 91 upwardly and forwardly from an area adjacent the rear edge of the cooking surface 16, as indicated by the arrows in FIG. 1. A second stream of air 92 flows from the conditioned air outlet 72 in the ceiling 20 into the region in front of the stove where the cook normally stands. A third stream of air 93 is discharged by the outlet 86 vertically downward toward the front portion of the cooking surface 16. Air is sucked out of the space above the cooking surface 16 by the exhaust blower 26. The second stream 92 generally consists of conditioned air, and the conditioned air flows around the cook to keep him comfortable. Thereafter, an appreciable fraction of the second stream 92 is drawn into the space above the cooking surface. As the second stream 92 passes over the front portion 96 of the cooking surface, it is compressed by the downwardly-directed third stream 93. This pinches the second stream causing the air of the third stream to attain a higher velocity, to become a rearwardly flowing jet which sweeps the cooking fumes into the area of the first stream 91. Above the cooking surface the second stream 92 merges into the first stream 91. The cooking fumes are captured between the two streams which then rise toward the mouth of the exhaust plenum.

The velocity of the third stream is critical; it must not be so great as to prevent entry of the second stream, yet it must be great enough to produce the desired pinching effect. The velocity of the third stream depends on the height of the outlet 86 above the cooking surface. Because low velocities are preferred to high velocities, it is desirable that the height of the outlet 86 above the cooking surface 16 be minimized, consistent with allowing the cook to see all parts of the cooking surface without stooping. In a preferred embodiment, the outlet 86 is 25 inches above the cooking surface, and in general the height will range between 18 and 40 inches depending on the depth of the cooking surface from front to back.

Figure 2:
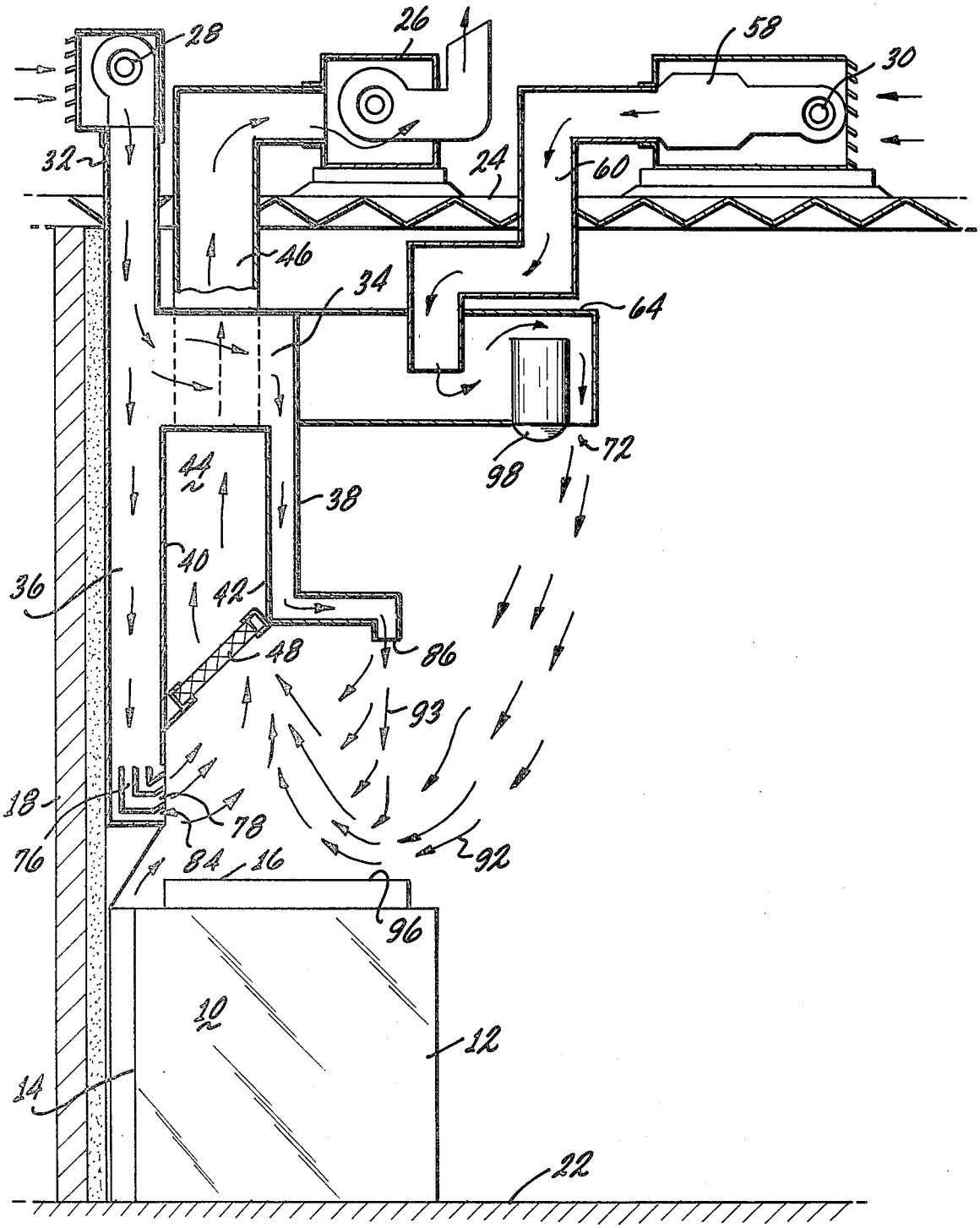
FIG. 2 is a side elevation view in cross section of another embodiment of the present invention in which the conditioned make-up air plenum is located below the ceiling of the kitchen, and in which the hood includes a plate shelf.

The embodiment of FIG. 2 is generally similar to that of FIG. 1 except that the conditioned air plenum 62 is located below the ceiling 20. In the embodiment of FIG. 2, the plenum 62 extends forward from the front of the front conduit 38, although the plenum 62 is sealed from the front conduit 38. If desired, a lamp 98 may be installed on the lower wall 66 of the plenum 62.

Figure 3:
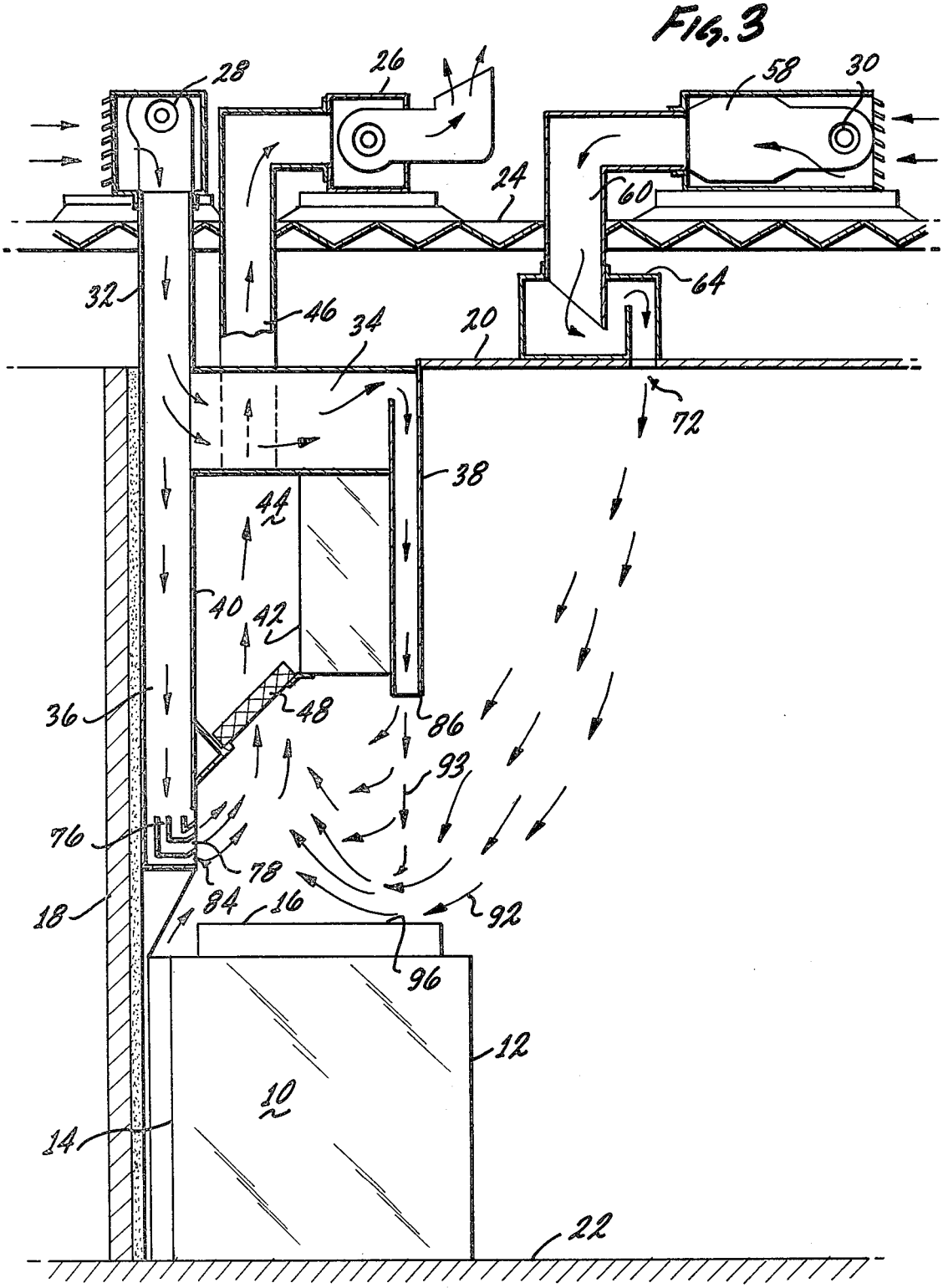
FIG. 3 is a side elevation view in cross section of a third embodiment, similar to the embodiment of FIG. 1 but without a plate shelf; and, FIG. 4 is a side elevation view in cross section of a fourth embodiment, similar to the embodiment of FIG. 2, but without a plate shelf.
Figure 4:
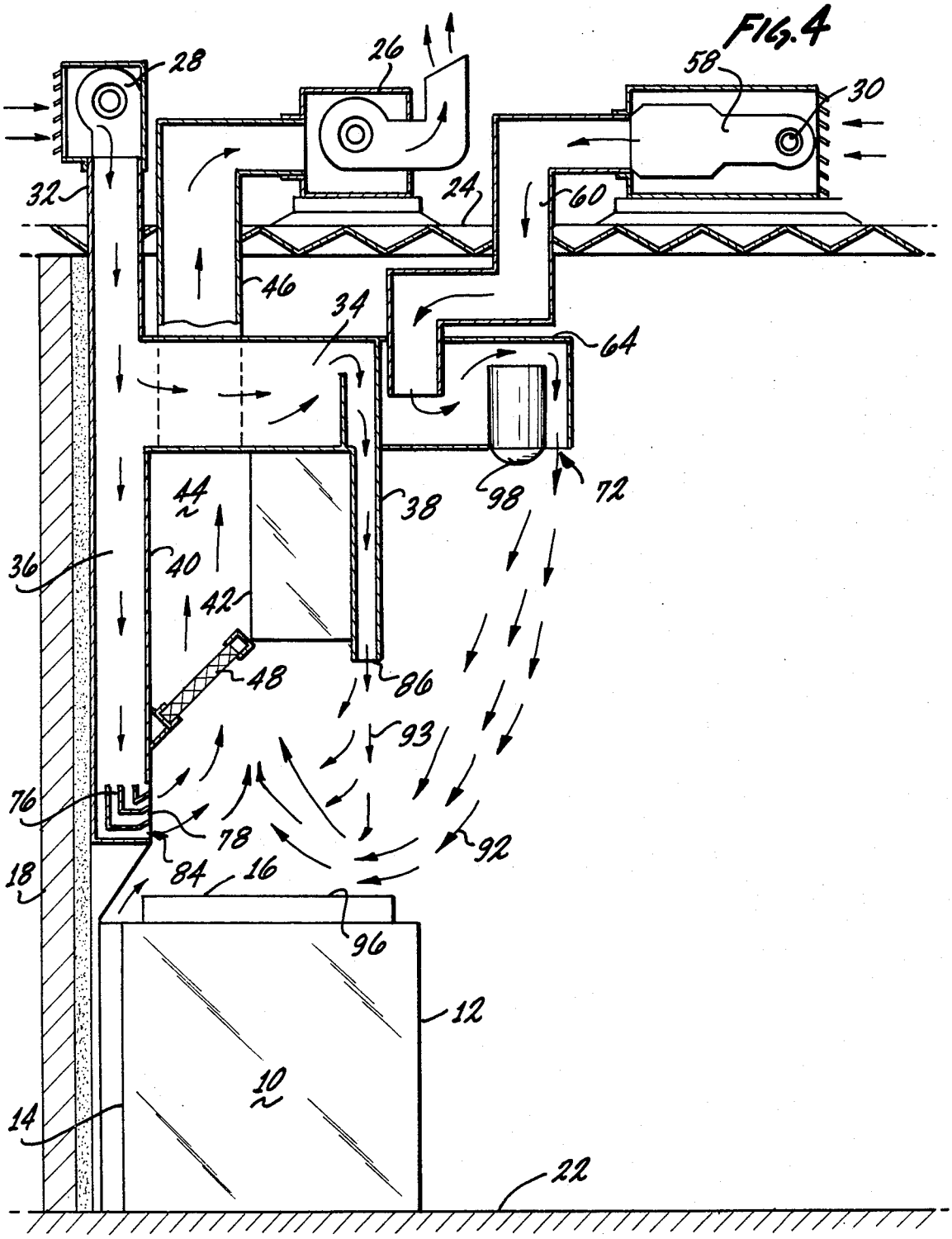

The embodiments of FIGS. 3 and 4 are generally similar to those of FIGS. 1 and 2 respectively, except that the front conduit 38 does not jog horizontally to provide a plate shelf (56 of FIGS. 1 and 2).

Thus, there has been described an energy-saving ventilator system for a kitchen stove in which relatively low speed air streams are arranged to interact in a highly efficient manner, minimizing the induction of conditioned air while providing great capacity to dispose of cooking fumes.

Although the invention has been described by reference to a preferred embodiment, it is understood that other embodiments will be obvious to those having skill in the art. Those additional embodiments are deemed to be comprehended within the present invention, which is limited only by the following claims.

What is claimed is:

1. In a kitchen stove ventilation system of the back shelf ventilator type in which a first stream of unconditioned air is discharged upwardly at the rear of a cooking surface of the kitchen stove and in which a second stream of conditioned make-up air flows from a region in front of the stove rearwardly over the front edge of the cooking surface to join with the first stream above the cooking surface to form a combined stream, the combined stream being drawn upward into an exhaust plenum, the improvement comprising:

a third stream outlet located above the front portion of the stove for discharing a curtain-like third stream of unconditioned air substantially vertically downwardly with sufficient velocity to restrict the thickness of the second stream as it flows over the front edge of the cooking surface but not with sufficient velocity to cut off the rearward flow of the second stream, whereby the second stream is pinched to form a rearwardly directed jet flowing above the cooking surface to transport cooking fumes toward the exhaust plenum;

a second stream outlet located in front of the stove and at a height greater than 6 feet above the floor;

a conditioned air plenum having an underside, said second stream outlet communicating with said conditioned air plenum and located on the underside of said conditioned air plenum, said conditioned air plenum further including a hollow chamber having a first wall, and having a second wall opposite said first wall;

an inlet duct extending into said hollow chamber through said first wall and opening into said hollow chamber at a position nearer to said second wall than to said first wall; and, an outlet duct extending into said hollow chamber through said second wall and opening into said hollow chamber at a position nearer to said first wall than to said second wall, said outlet duct connected outside said hollow chamber to said second stream outlet.

2. The improvement of claim 1 further comprising a perforated metal plate located in said outlet duct and extending across the space within said duct to limit the flow rate of the second stream.

* * * * *